US005872620A

United States Patent [19]

Wakamiya

[11] Patent Number: 5,872,620

[45] Date of Patent: Feb. 16, 1999

[54] CONTROL APPARATUS OF HEAT FIXING UNIT OF IMAGE RECORDING APPARATUS

[75] Inventor: Hidehiro Wakamiya, Chiba, Japan

[73] Assignee: Canon Kabushiki Kaisha, Tokyo, Japan

[21] Appl. No.: 606,276

[22] Filed: Feb. 23, 1996

[30] Foreign Application Priority Data

Feb. 27, 1995 [JP] Japan ..... 7-63418

[51] Int. Cl.[6] ..... G03G 15/20; G03G 15/00

[52] U.S. Cl. ..... 355/69; 216/216; 216/490

[58] Field of Search ..... 396/575, 572; 355/320, 330, 335, 336–338; 219/216, 490, 492, 494; 399/67–69, 33, 320, 335, 336

[56] References Cited

U.S. PATENT DOCUMENTS

| | | | |
|---|---|---|---|
| 5,140,132 | 8/1992 | Shiokawa | 219/216 |
| 5,220,389 | 6/1993 | Kishimoto et al. | 399/69 |
| 5,502,546 | 3/1996 | Muto | 399/335 |

*Primary Examiner*—D. Rutledge

*Attorney, Agent, or Firm*—Fitzpatrick, Cella, Harper & Scinto

[57] ABSTRACT

In order to reduce a temperature change of a fixing unit and to prevent a reduction of the life of a switching device for controlling the current supply of a heater of the fixing unit and to reduce flickering noises, an on/off control of the heater is executed in every predetermined period and the order of ON and OFF states of the heater is changed every period when the fixing unit is heated.

6 Claims, 8 Drawing Sheets

CONTROL APPARATUS OF HEAT FIXING UNIT OF IMAGE RECORDING APPARATUS

BACKGROUND OF THE INVENTION

1. Field of the Invention

The present invention relates to a control apparatus of a heat fixing unit of an image recording apparatus.

2. Related Background Art

Hitherto, the are a variety of image recording apparatuses in which a developing agent is pressurized with heat and is fixed by a fixing unit using a heat roller (fixing roller) having therein a halogen heater as a heating source. A temperature adjustment is executed so as to maintain a predetermined temperature by detecting a surface temperature of the heat roller.

On the other hand, the image recording apparatus of this kind use recording papers of various sizes and has a tendency toward higher and higher recording speeds. When a recording paper having a narrow width in the axial direction of the heat roller is used and the recording is successively performed, since the heat loss of a paper passing unit is larger than that of a paper non-passing unit, a temperature difference occurs between the paper passing unit and the paper non-passing unit of the heat roller. When recording is performed by using a recording paper of a wide width immediately after that, a fixing fluctuation occurs.

In order to avoid the fixing fluctuation, there is also an image recording apparatus which controls the fixing temperature so as to reduce the temperature difference by reducing a turn-on time of each heater by using two halogen heaters.

In case of executing the control in which the turn-on period is reduced by using the two halogen heaters like the above conventional apparatus, however, there are problems such that the life of a switching device is reduced by a rush current which flows at the time of turn-on of the heater and a flickering often occurs in illuminating equipment or the like connected to the same power source as that of the image recording apparatus due to the rush current.

SUMMARY OF THE INVENTION

It is an object of the invention to provide an image recording apparatus and a control method of a fixing unit, in which the above mentioned problems are eliminated.

Another object of the invention is to provide an image recording apparatus and a control method of a fixing unit, in which a temperature change in the fixing unit can be reduced.

Further another object of the invention is to provide an image recording apparatus and a control method of a fixing unit, in which a reduction of the life of a switching device for driving a heater of the fixing unit can be prevented and a flickering can be reduced.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will now be described hereinbelow with reference to the drawings.

[First embodiment]

Figure 1:
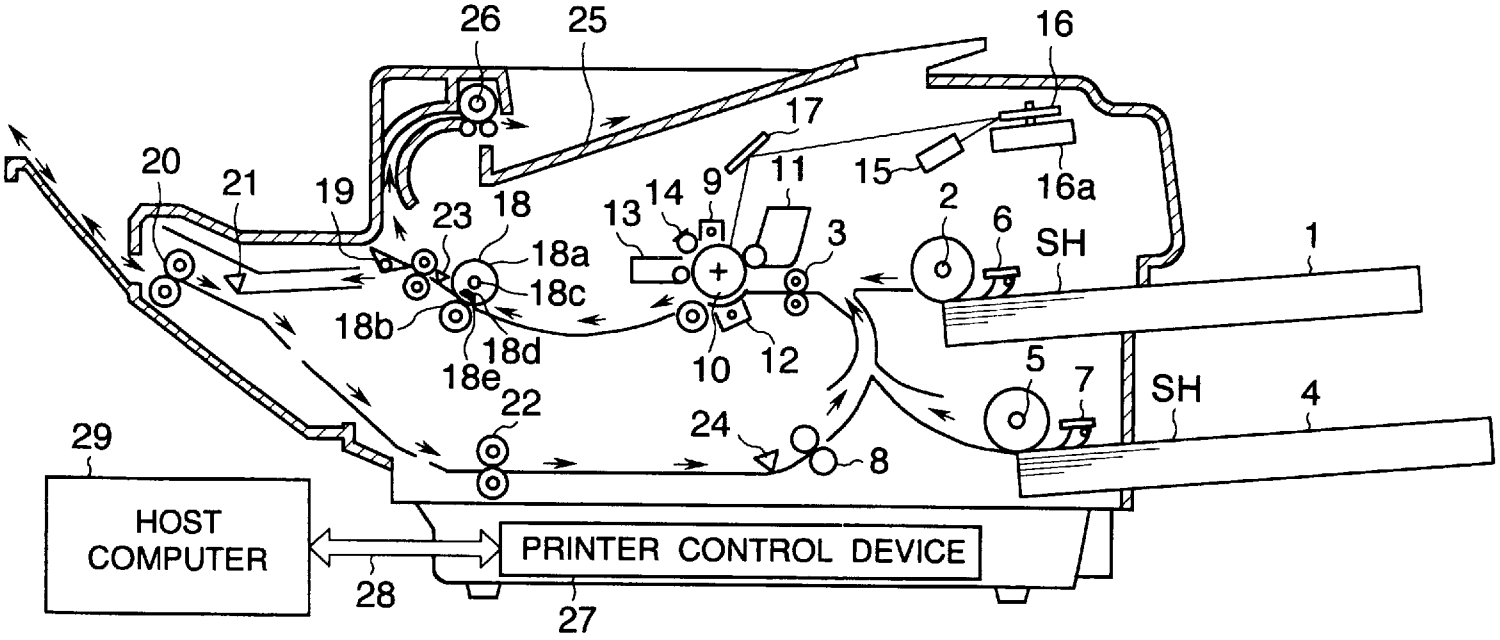
FIG. 1 is a vertical sectional view showing a construction of an image recording apparatus according to the first embodiment of the invention.

The first embodiment of the invention will now be described with reference to FIGS. 1 to 6. FIG. 1 is a vertical sectional view showing a construction of a laser printer as an image recording apparatus according to the first embodiment of the invention. In FIG. 1, reference numeral 1 denotes an upper cassette in which recording papers SH serving as recording media have been enclosed; 2 a feed roller for feeding the recording papers SH enclosed in the upper cassette 1 one by one to an arranging position of a register roller 3; 4 a lower cassette in which the recording papers SH serving as recording media have been enclosed; 5 a feed roller for feeding the recording papers SH enclosed in the lower cassette 4 one by one to the arranging position of the register roller 3; and 6 and 7 recording paper size sensors for detecting the sizes of the recording papers enclosed in the upper and lower cassettes 1 and 4.

The register roller 3 conveys the recording paper SH which is fed from the feed roller 2 or 5 or a re-feed roller 8 to an image recording portion at a predetermined timing.

Reference numeral 9 denotes a primary charging unit for uniformly charging a photosensitive drum 10. Reference numeral 11 indicates a developing unit for jumping developing an electrostatic latent image formed around the surface of the photosensitive drum 10 by, for example, a toner. Reference numeral 12 denotes a transfer charging unit for transferring the toner image developed by the developing unit 11 onto the recording paper SH; 13 a cleaning device for collecting the toner remaining on the surface of the photosensitive drum 10; 14 a charge removal lamp for neutralizing residual charges by exposing the photosensitive drum 10; and 15 a laser unit for irradiating a laser beam to a polygon mirror 16 which is rotated at a predetermined speed by a scanner motor 16*a*, thereby forming an image according to image information onto the surface of the photosensitive drum 10 via a reflecting mirror 17.

Reference numeral 18 denotes a fixing unit which is constructed of: a heat roller 18*a*; a pressurizing roller 18*b*; a main heater 18*c* and a sub-heater 18*d* which are provided in the heat roller 18*a* and have different light distributions; and a thermistor 18*e* serving as a temperature detecting device for detecting a surface temperature of the heat roller

18*a*. The fixing unit 18 fixes the toner image onto the recording paper SH after the transfer process by applying heat and pressure from the heat roller 18*a* and pressurizing roller 18*b*. Reference numeral 19 indicates a flapper for controlling the conveying direction of the recording paper SH after the fixing process. Reference numeral 20 denotes a reversing roller which rotates in one direction and ejects the recording paper SH after the fixing process to the outside of the apparatus when the recording mode is a one-side mode. When the recording mode is a both-side mode, the reversing roller 20 rotates in one direction, thereby feeding the recording paper SH after the fixing process in the paper ejecting direction. The reversing roller 20 rotates in the opposite direction immediately after the rear edge portion of the recording paper SH passed through a reversal sensor 21 and pulls the recording paper SH into the apparatus. Reference numeral 22 denotes a relay roller for relaying and conveying the recording paper SH which was reversed by the reversing roller 20 to an arranging position of the re-feed roller 8.

Reference numerals 23 and 24 denote paper pass sensors for detecting a passing state of the recording paper SH; 25 denotes a stacking tray for stacking and ejecting the printed recording papers SH by a driving of an exit roller 26; 27 is a printer control device which is connected to a host computer 29 serving as an external apparatus through an interface 28, and which receives the image information, controls the driving of the laser unit 15 or the like, and integratedly controls the driving of drivers which are necessary for a printing sequence.

Figure 2:
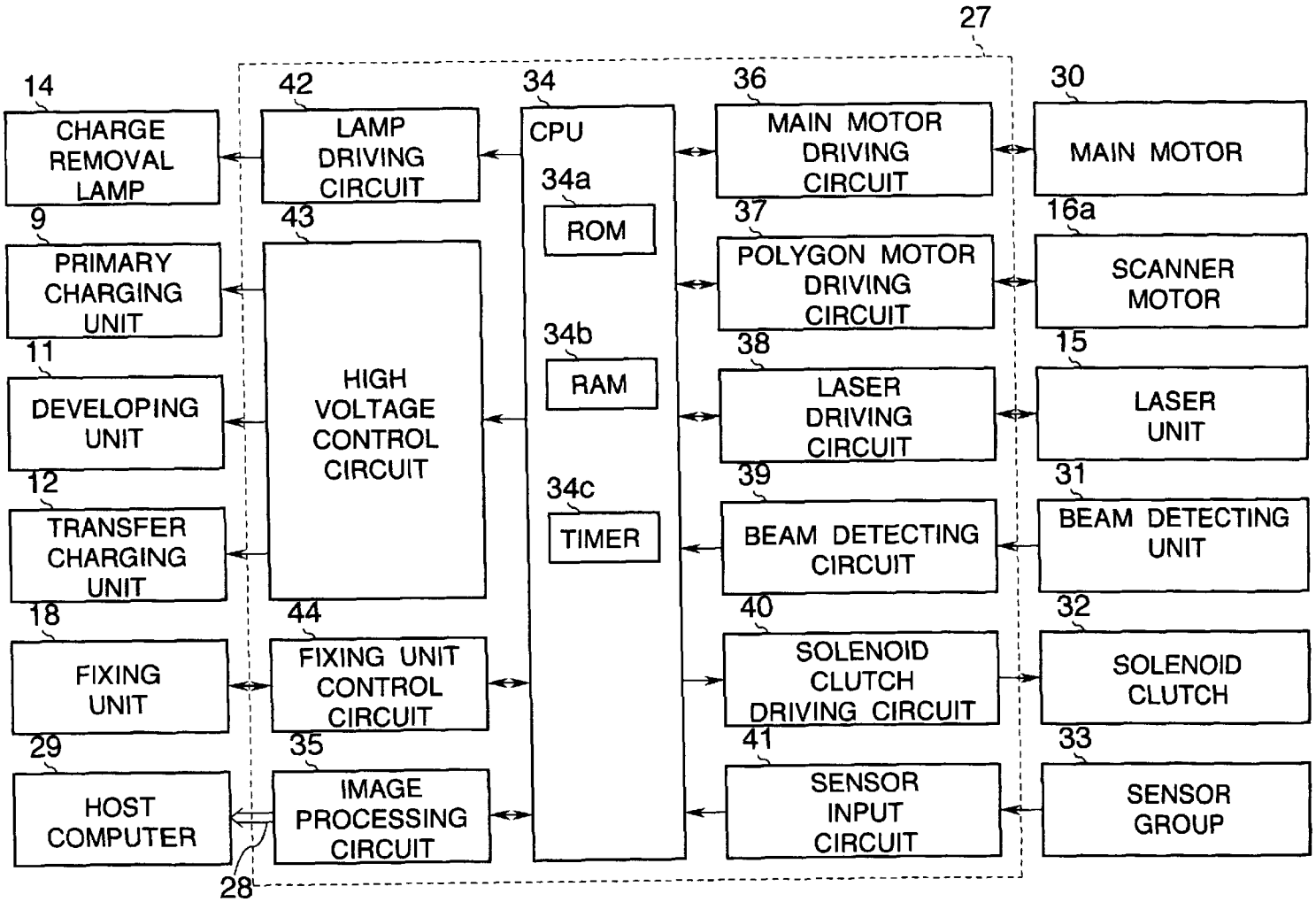
FIG. 2 is a circuit diagram showing a construction of a printer control device in the image recording apparatus according to the first embodiment.

FIG. 2 is a block diagram showing a construction of the printer control device 27 in the image recording apparatus of FIG. 1. In FIG. 2, portions similar to those in FIG. 1 are designated by the same reference numerals.

In FIG. 2, reference numeral 30 denotes a main motor for driving the feed rollers 2 and 5, re-feed roller 8, photosensitive drum 10, reversing roller 20, relay roller 22, and the like shown in FIG. 1. Reference numeral 31 indicates a beam detecting unit for receiving the laser beam emitted from the laser unit 15 at a position just before an image writing and outputting a beam detection signal which becomes a horizontal sync signal. Reference numeral 32 denotes a solenoid clutch for turning on or off the driving of the feed rollers 2 and 5, re-feed roller 8, photosensitive drum 10, reversing roller 20, relay roller 22, and the like shown in FIG. 1. Reference numeral 33 denotes a sensor group which is constructed by the reversal sensor 21, paper pass sensors 23, 24, and the like shown in FIG. 1.

Reference numeral 34 denotes a CPU (central processing unit) of one chip for controlling the printer control device 27. The CPU 34 has an ROM (read only memory) 34*a*, an RAM (random access memory) 34*b*, and a timer 34*c*. Reference numeral 35 indicates an image processing circuit for transmitting the image information and a print control command from the host computer 29 to the CPU 34 in the format and at a timing described in the sequence of the printer. Reference numeral 36 denotes a main motor driving circuit for driving the main motor 30 at a predetermined rotational speed; 37 a polygon motor driving circuit for driving the scanner motor (polygon motor) 16*a* for rotating the polygon mirror 16 at a predetermined rotational speed; 38 a laser driving circuit for modulating and emitting the laser beam in accordance with the image information inputted from the host computer 29; and 39 a beam detecting circuit for shaping the beam detection signal outputted from the beam detecting unit 31, thereby generating a horizontal sync signal.

Reference numeral 40 denotes a solenoid clutch driving circuit for driving the solenoid clutch 32; 41 a sensor input circuit for supplying outputs from the sensor group 33 to the CPU 34; 42 a lamp driving circuit for turning on or off the charge removal lamp 14; 43 a high voltage control circuit for applying predetermined voltages to the primary charging unit 9, developing unit 11 and transfer charging unit 12; and 44 a fixing unit control circuit for controlling a temperature of the fixing unit 18 to a predetermined temperature.

The operation of the image recording apparatus according to the embodiment with the above construction will now be described with reference to FIGS. 1 and 2.

First, the host computer 29 designates a feed port of the recording paper SH (feeding from the feed roller 2 or 5 or feeding from the re-feeder 8) and a destination of the recording paper for the printer control device 27. Then, the host computer 29 instructs a start of the recording.

When a recording start command is received from the host computer 29, the printer control device 27 individually sets the temperature of the fixing unit 18 on the basis of the designated feed port and destination of the recording paper SH.

Figure 3A:
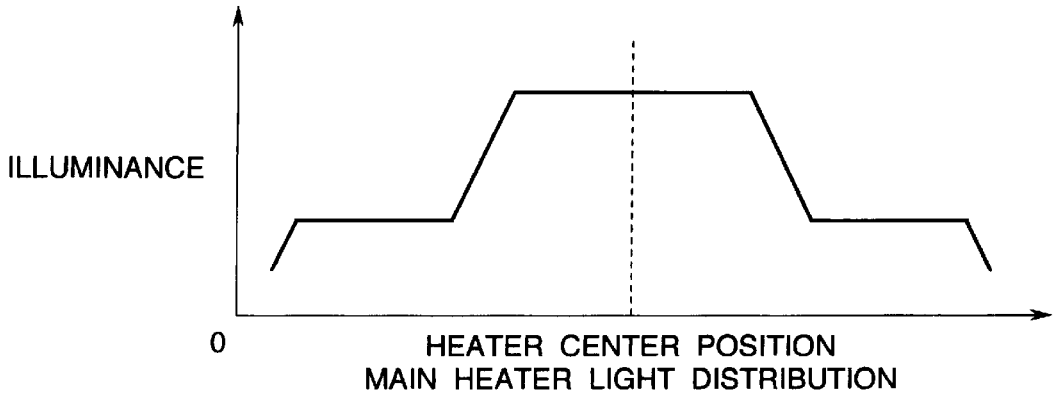
FIGS. 3A and 3B are diagrams showing light distributions of a main heater and a sub-heater in the image recording apparatus according to the first embodiment.
Figure 3B:
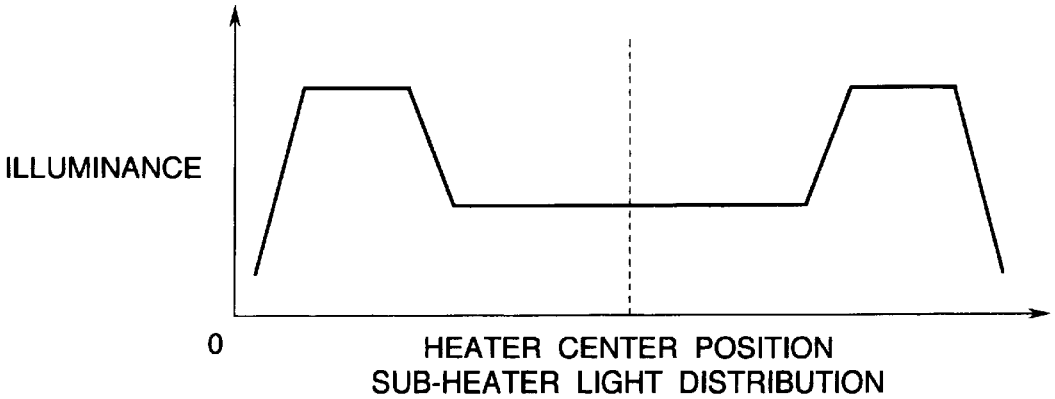

FIGS. 3A and 3B show an example of light distributions of the main heater 18*c* and sub-heater 18*d* of the fixing unit 18. FIG. 3A shows the light distribution of the main heater 18*c* and FIG. 3B shows the light distribution of the sub-heater 18*d*. The above light distributions are merely shown as examples and can be also changed to other light distributions in accordance with a paper passing portion of the recording paper SH.

Figure 4:
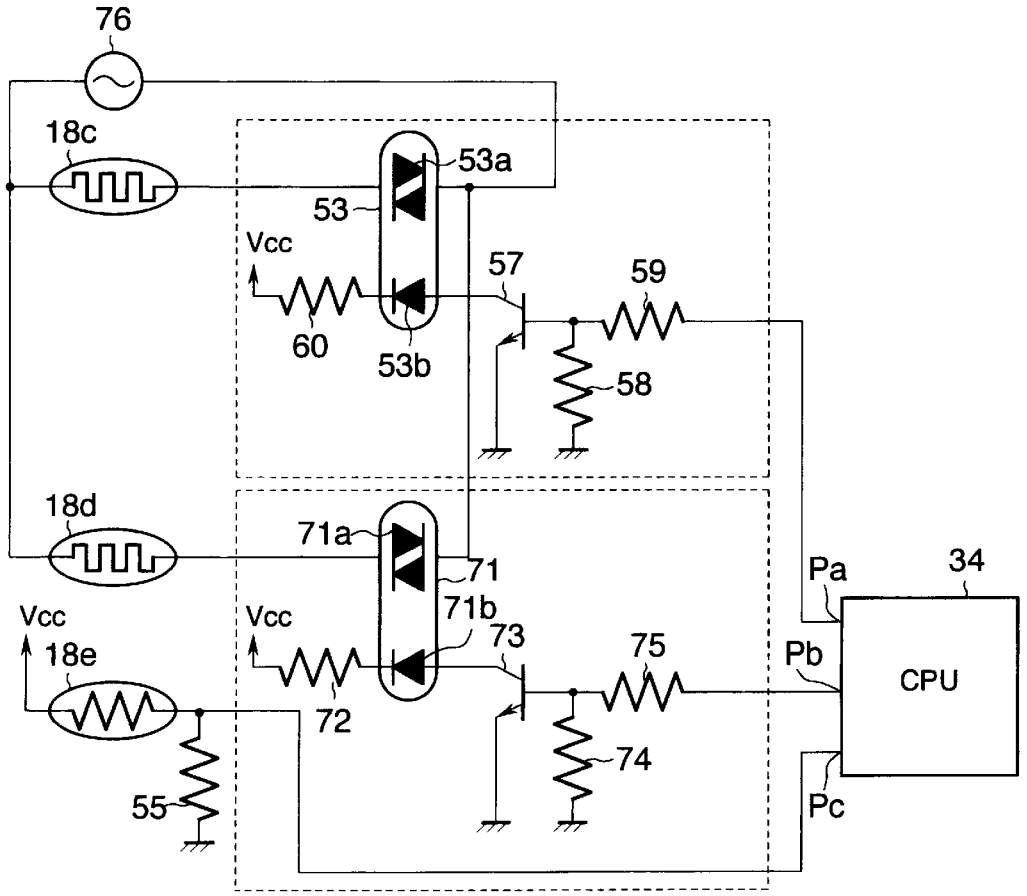
FIG. 4 is a block diagram showing a construction of a fixing unit control circuit in the image recording apparatus according to the first embodiment.

FIG. 4 is a circuit diagram showing a construction of a portion in the printer control device 27 regarding the temperature control of the fixing unit 18. In the diagram, the main heater 18*c* in the fixing unit 18 is connected to a commercially available power source through a triac 53*a* in a first SSR (solid state relay). The first SSR 53 is constructed by the triac 53*a*, an LED (light emitting diode) 53*b*, a zero-cross detecting circuit (not shown), and the like. When the LED 53*b* emits a light, the triac 53*a* is made conductive and the main heater 18*c* is turned on. An anode of the LED 53*b* is connected to a DC (direct current) power source through a first resistor 60 and a cathode is connected to a collector of an NPN type transistor 57 with a common emitter. A base of the transistor 57 is connected to a first output port Pa of the CPU 34 through a second resistor 58 connected to the ground and a third resistor 59. When the first output port Pa of the CPU 34 is set to the low (L) level, the transistor 57 is turned off and the LED 53*b* is not turned on, so that the main heater 18*c* isn't turned on. When the first output port Pa of the CPU 34 is set to the high (H) level, the transistor 57 is turned on and the LED 53*b* is turned on, so that the main heater 18*c* is turned on.

The sub-heater 18*d* in the fixing unit 18 is connected to the commercially available power source through a triac 71*a* in a second SSR (solid state relay) 71. The second SSR 71 is constructed by the triac 71*a*, an LED (light emitting diode) 71*b*, a zero-cross detecting circuit (not shown), and the like. When the LED 71*b* emits a light, the triac 71*a* is made conductive and the sub-heater 18*d* is turned on. An anode of the LED 71*b* is connected to a DC (direct current) power source through a fourth resistor 72 and a cathode is connected to a collector of an NPN type transistor 73 with a common emitter. A base of the transistor 73 is connected to a second output port Pb of the CPU 34 through a fifth resistor 74 connected to the ground and a sixth resistor 75. When the second output port Pb of the CPU 34 is set to the L level (OFF), therefore, the LED 53*b* is not turned on, so that the main heater 18*c* is not turned on. When the second output port Pb of the CPU 34 is set to the H level (ON), the LED 53*b* is turned on and the main heater 18*c* is turned on.

On the other hand, one end of the thermistor 18*e* in the fixing unit 18 is connected to the DC power source and the other end is connected to a seventh resistor 55. An analog voltage of the thermistor 18*e* which is determined by a value of the seventh resistor 55 is input to an A/D conversion input port Pc of the CPU 34 and the CPU 34 detects the temperature of the fixing unit 18.

In FIG. 4, reference numeral 76 denotes an AC (alternate current) power source.

Figure 5:
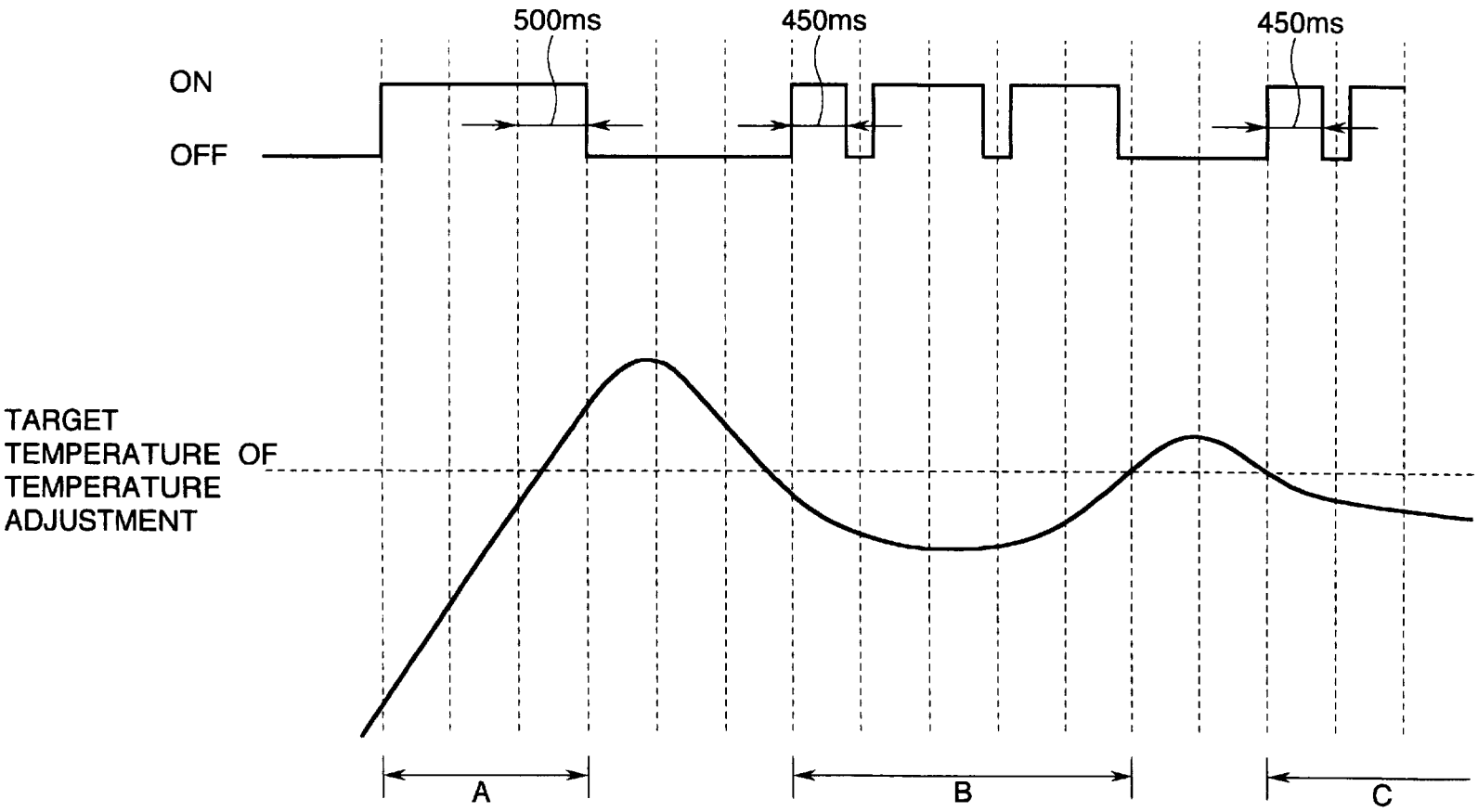
FIG. 5 is a diagram showing an example of a temperature adjustment control of the heater in the image recording apparatus according to the first embodiment.
Figure 6:
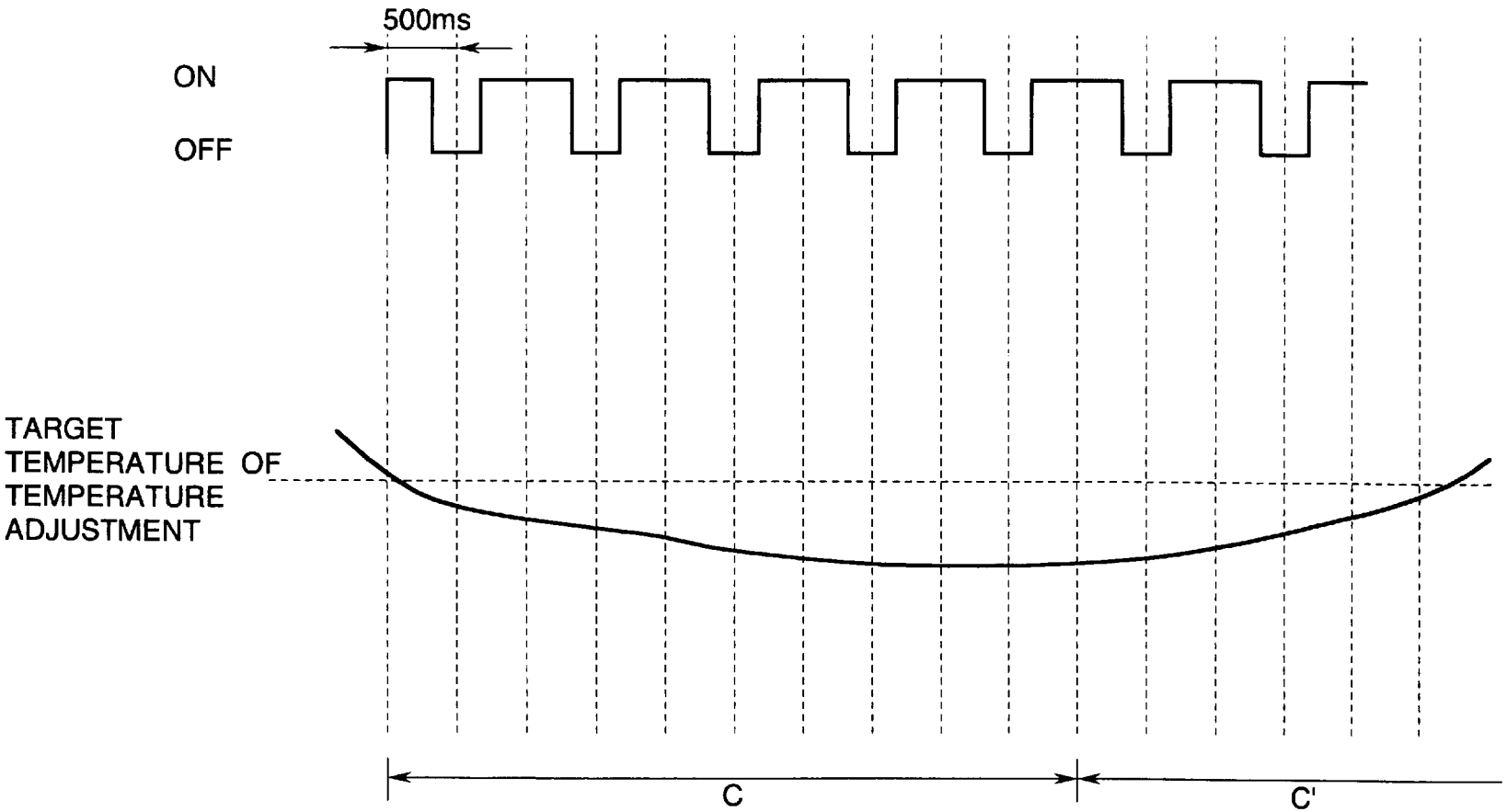
FIG. 6 is a diagram showing an example of the temperature adjustment control of the heater in the image recording apparatus according to the first embodiment.

The driving control operation of the heater (main heater 18*c* and sub-heater 18*d*) when the printing is executed by using the fixing unit 18 will now be described with reference to FIGS. 5 and 6. FIGS. 5 and 6 are diagrams showing an example of a temperature adjustment control of the heater by the image recording apparatus according to the embodiment.

In the heater control, as shown in FIG. 5, 500 msec is set to one period, a heater turn-on time within 500 msec is adjusted, and the heater driving period of 500 msec unit is continued.

A specific description will now be made hereinbelow. When the printing is started by an ordinary on/off control, the heater is continuously held in the full ON state for the heater driving period of 500 msec until the temperature of the fixing unit exceeds a target temperature of the temperature adjustment for the first time (A area). At a time point when the temperature of the fixing unit exceeds the target temperature of the temperature adjustment, the heater is turned off and the OFF state is continued until the temperature of the fixing unit again decreases to the target temperature of the temperature adjustment or less. When the temperature of the fixing unit is lower than the target temperature of the temperature adjustment, the ON time of the heater in the heater driving period of 500 msec is reduced by 10% (B area) and the heater is turned on for this ON time. That is, the heater is turned on for only 450 msec per period. By certainly alternately executing the on/off operations by changing the order of ON/OFF states every period like on→off, off→on, on→off, . . . , the number of on/off times is reduced. The on/off control of the heater is executed by the CPU 34. Thus, flickering can be reduced.

Such a state is equivalent to an electric power reduction of 10% as compared with that in case of the full ON state and a temperature increase of the heat roller 18*a* is also small. That is, by repeating such a sequence, the electric power to be supplied is smaller than the electric power consumption. There occurs a case such that even in a state in which the heater driving period of 500 msec continues, the temperature of the heat roller 18*a* continuously decreases.

As shown in a (C) area in FIG. 6, in the case where the temperature doesn't reach the target temperature of the temperature adjustment even when the heater is continuously turned on for 10 periods or more, or in the case where the temperature of the heat roller 18*a* continuously decreases, by increasing the turn-on time in one period by 5%, the temperature of the heat roller 18*a* is recovered. In this case as well, the on/off operations are controlled so as to be certainly alternately executed by changing the order of the ON/OFF states.

When the temperature of the heat roller 18*a* increases by the successive turn-on, the turn-on time is reduced by 10% at the time point when the temperature of the heat roller 18*a* exceeds the target temperature of the temperature adjustment. After that, when the temperature of the heat roller 18*a* decreases to the target temperature of the temperature adjustment or less and doesn't reach the target temperature of the temperature adjustment even if the heater is continuously turned on for ten periods, the turn-on time of the heater is increased by 5%. The on/off operations are controlled so as to be certainly alternately executed by changing the order of the ON/OFF states, thereby performing the stable temperature adjustment in which a temperature change is small, so that the life of the triac as a switching device of the heater can be increased and, further, the flickering can be reduced.

Although the driving period of the heater has been set to 500 msec in the above embodiment, the value of the driving period of the heater can be set to an optimum value in accordance with a print speed, an external shape or a thickness of the heat roller 18*a*, a rated power of the heater, or the like. Although the decreasing time of the turn-on time of the heater has been set to 10% and the increasing time has been set to 5% and the judgement time until the increase has been set to 10 periods, those values can be also set to optimum values in accordance with the construction of the fixing unit 18, the print speed, or the like.

[Second embodiment]

Figure 7:
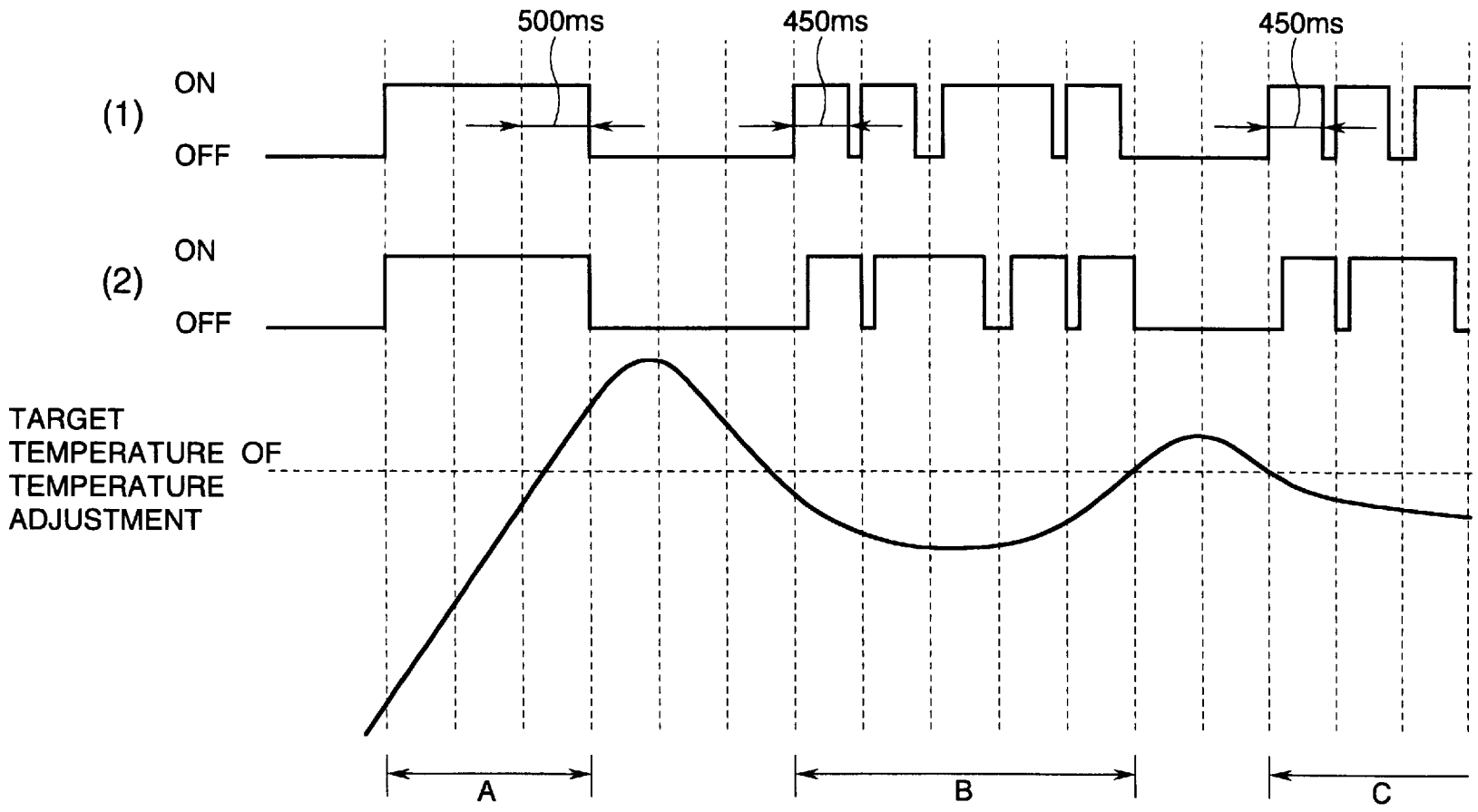
FIG. 7 is a diagram showing an example of a temperature adjustment control of a heater in an image recording apparatus according to the second embodiment of the invention.
Figure 8:
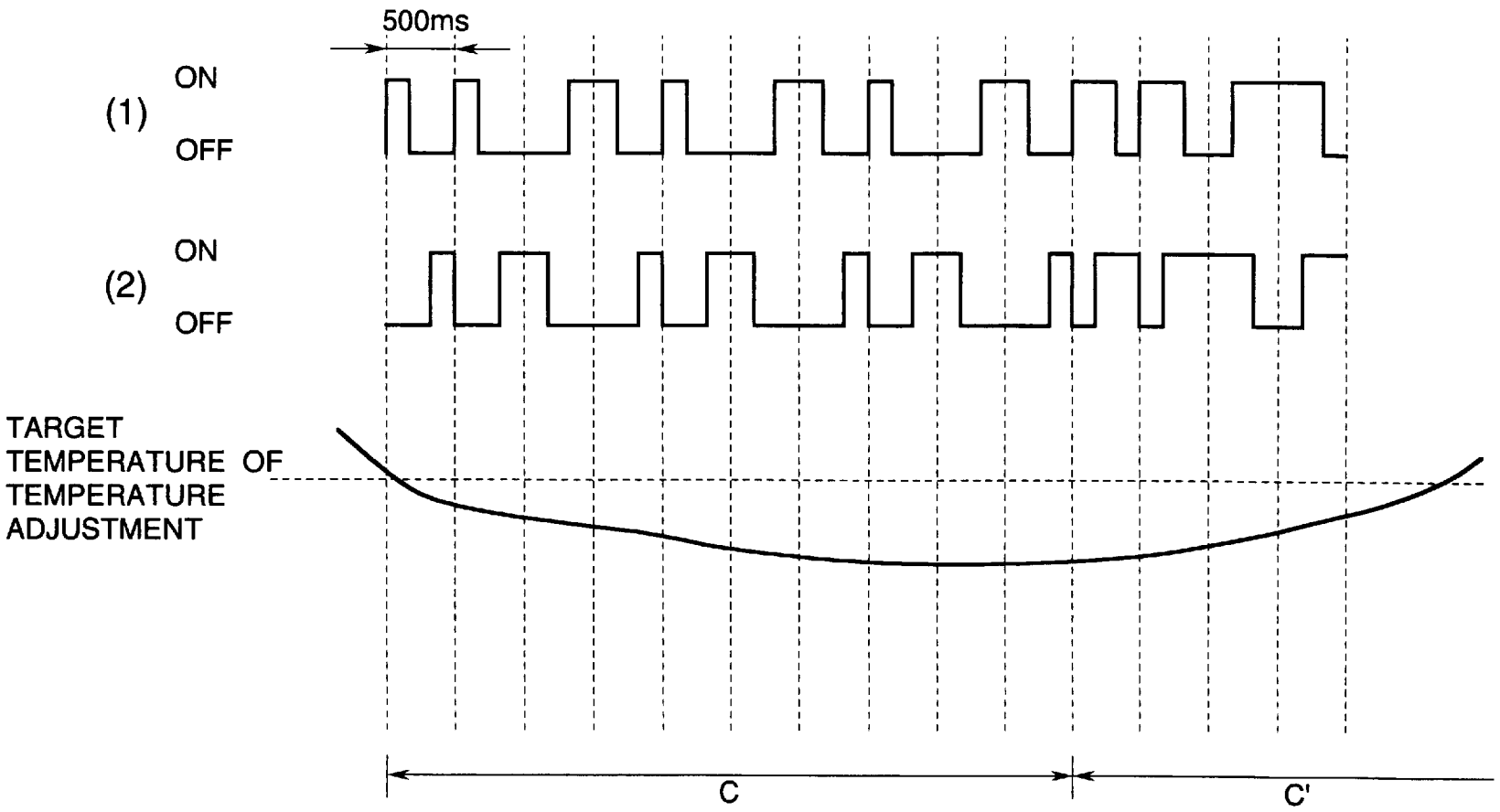
FIG. 8 is a diagram showing an example of the temperature adjustment control of the heater in the image recording apparatus according to the second embodiment.

The second embodiment of the invention will now be described with reference to FIGS. 7 and 8. FIGS. 7 and 8 are diagrams showing an example of the temperature adjustment control of the heater by an image recording apparatus according to the second embodiment of the invention. In the embodiment, a basic construction of the image recording apparatus is substantially the same as that shown in FIGS. 1 to 4 of the first embodiment mentioned above.

In the first embodiment, when the heater is turned on and off, it is certainly alternately turned on and off every period by changing the order of the ON/OFF states like on off, off→on, on→off, . . . . On the contrary, in the second embodiment, the on/off operations are controlled in a manner such that the heater is turned on twice by the same order and is turned off by the opposite order in accordance with the order such as on→off, on→off, off→on as shown in (1) in FIG. 7 and (1) in FIG. 8 or in accordance with the order such as off→on, off→on, on→off as shown in (2) in FIG. 7 and (2) in FIG. 8, thereby decreasing the number of turn-on times.

The controls as shown in the first and second embodiments mentioned above can be also executed by any combination of the main heater 18*c* and sub-heater 18*d*.

The present invention is not limited to the foregoing embodiments but many modifications and variations are possible within the spirit and scope of the appended claims of the invention.

What is claimed is:

1. An image recording apparatus comprising:

a fixing unit which has a heater and fixes by heat a developing agent transferred onto a sheet;

detecting means for detecting a temperature of said fixing unit; and control means for repeatedly controlling an on-time of the heater during a predetermined period on the basis of a result obtained by comparing the temperature detected by said detecting means with a control target temperature, wherein said control means controls an order of ON and OFF states of said heater so that the order of ON and OFF states is ON, OFF, OFF and ON or OFF, ON, ON and OFF in at leat two sequential predetermined periods.

2. An apparatus according to claim 1, wherein in the case where the temperature of said fixing unit exceeds a target temperature once and, after that, decreases at least to said target temperature, said control means controls the order of ON and OFF states every period.

3. An image recording apparatus comprising:

a fixing unit which has a heater and fixes by heat a developing agent transferred onto a sheet;

detecting means for detecting a temperature of said fixing unit; and control means for controlling an on-time of the heater during a predetermined period on the basis of a result obtained by comparing the temperature detected by said detecting means with a control target temperature, wherein said control means controls an order of ON and OFF states of said heater so that the order of ON and OFF states is not ON, OFF, ON and OFF or OFF, ON, OFF, ON, OFF and ON in three sequential predetermined periods.

4. An apparatus according to claim 3, wherein in the case where the temperature of said fixing unit exceeds a target temperature once and, after that, decreases to said target temperature or less, said control means controls the order of ON and OFF states every period.

5. A method of controlling a fixing unit of an image recording apparatus, comprising the steps of:

detecting a temperature of the fixing unit; and controlling repeatedly an on-time of the heater during a predetermined period on the basis of a result obtained by comparing the temperature detected in said detecting step with a control target temperature, wherein said controlling step controls an order of ON and OFF states of the heater so that the order of ON and OFF states is ON, OFF, OFF and ON or OFF, ON, ON and OFF in at least two sequential predetermined periods.

6. A method of controlling a fixing unit of an image recording apparatus, comprising the steps of:

detecting a temperature of the fixing unit; and controlling repeatedly an on-time of a heater during a predetermined period on the basis of a result obtained by comparing the temperature detected in said detecting step with a control target temperature, wherein said controlling step controls an order of ON and OFF states of the heater so that the order of ON and OFF states is not ON, OFF, ON, OFF, ON and OFF or OFF, ON, OFF, ON, OFF and ON in three sequential predetermined periods.

* * * * *

UNITED STATES PATENT AND TRADEMARK OFFICE

CERTIFICATE OF CORRECTION

PATENT NO. : 5,872,620

DATED : February 16, 1999

INVENTOR(S) : HIDEHIRO WAKAMIYA

It is certified that error appears in the above-identified patent and that said Letters Patent is hereby corrected as shown below:

COVER PAGE [56] OTHER PUBLICATIONS,
Insert --Patents Abstracts of Japan, Vol. 017, No. 255 (P-1539), May 20, 1993 & JP 04-372977 (Fuji Xerox Co. Ltd.) Dec. 25, 1992.--.

COLUMN 1,
Line 25, "by" should be deleted.

COLUMN 5,
Line 42, "that in" should read --the--.

COLUMN 6,
Line 28, "on off," should read --on→off,--.

Signed and Sealed this

Seventeenth Day of August, 1999

*Attest:*

*Attesting Officer*

Q. TODD DICKINSON

*Acting Commissioner of Patents and Trademarks*